US010233520B2

(12) United States Patent
Soma et al.

(10) Patent No.: US 10,233,520 B2
(45) Date of Patent: Mar. 19, 2019

(54) LOW-ALLOY STEEL PIPE FOR AN OIL WELL

(71) Applicant: NIPPON STEEL & SUMITOMO METAL CORPORATION, Tokyo (JP)

(72) Inventors: Atsushi Soma, Wakayama (JP); Yuji Arai, Amagasaki (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 185 days.

(21) Appl. No.: 15/108,825

(22) PCT Filed: Jun. 4, 2015

(86) PCT No.: PCT/JP2015/066133

§ 371 (c)(1),
(2) Date: Jun. 29, 2016

(87) PCT Pub. No.: WO2015/190377

PCT Pub. Date: Dec. 17, 2015

(65) Prior Publication Data

US 2017/0081746 A1 Mar. 23, 2017

(30) Foreign Application Priority Data

Jun. 9, 2014 (JP) ..... 2014-118849

(51) Int. Cl.
*C22C 38/22* (2006.01)
*C22C 38/24* (2006.01)
(Continued)

(52) U.S. Cl.
CPC ..... *C22C 38/32* (2013.01); *C21D 8/10* (2013.01); *C21D 8/105* (2013.01); *C21D 9/08* (2013.01);
(Continued)

(58) Field of Classification Search
None
See application file for complete search history.

(56) References Cited

FOREIGN PATENT DOCUMENTS

| | | |
|---|---|---|
| EP | 0828007 | 3/1998 |
| EP | 1197571 | 4/2002 |

(Continued)

OTHER PUBLICATIONS

Machine-English translation of JP 2000-297344 A, Kondo Kunio et al., Oct. 24, 2000.*

*Primary Examiner* — Deborah Yee
(74) *Attorney, Agent, or Firm* — Clark & Brody

(57) ABSTRACT

A low-alloy steel pipe includes C: 0.15% to less than 0.30%, Si: 0.05 to 1.00%, Mn: 0.05 to 1.00%, P: at most 0.030%, S: at most 0.0050%, Al: 0.005 to 0.100%, O: at most 0.005%, N: at most 0.007%, Cr: 0.10% to less than 1.00%, Mo: 1.0% to not more than 2.5%, V: 0.01 to 0.30%, Ti: 0.002 to 0.009%. Nb: 0 to 0.050%, B: 0 to 0.0050%, Ca: 0 to 0.0050%, Mo/Cr≥2.0, and the balance being Fe and impurities. The pipe has a crystal grain size number of 7.0 or more, 50 or more particles of cementite based on equivalent circle diameter and area of the matrix, $M_2C$-based alloy carbide in a number density of not less than 25/μm$^2$, and a yield strength of 758 MPa or more.

8 Claims, 4 Drawing Sheets

(51) Int. Cl.

| | |
|---|---|
| ***C22C 38/28*** | (2006.01) |
| ***C22C 38/32*** | (2006.01) |
| ***C21D 9/14*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/26*** | (2006.01) |
| ***C21D 9/08*** | (2006.01) |
| ***C22C 38/06*** | (2006.01) |

(52) U.S. Cl.

CPC ..... *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C21D 2211/003* (2013.01); *C21D 2211/004* (2013.01); *C21D 2211/008* (2013.01)

(56) References Cited

FOREIGN PATENT DOCUMENTS

| | | |
|---|---|---|
| JP | 2000-178682 | 6/2000 |
| JP | 2006-265657 | 10/2006 |
| JP | 2010-532821 | 10/2010 |
| JP | 5387799 | 1/2014 |
| JP | 5522322 | 6/2014 |
| WO | 2007/007678 | 1/2007 |
| WO | 2008/123425 | 10/2008 |
| WO | 2010/150915 | 12/2010 |

* cited by examiner

LOW-ALLOY STEEL PIPE FOR AN OIL WELL

BACKGROUND

Technical Field

The present invention relates to a low-alloy steel pipe for an oil well and, more particularly, to a high-strength low-alloy steel pipe for an oil well.

Description of the Background Art

A steel pipe for an oil well may be used as a casing or tubing for an oil well or gas well. Both an oil well and a gas well will be hereinafter referred to as "oil well". As deeper and deeper oil wells are developed, a steel pipe for an oil well is required to have higher strength. Traditionally, steel pipes for oil wells in the 80 ksi strength grade (i.e. with a yield strength in the range of 80 to 95 ksi, i.e. a yield strength in the range of 551 to 654 MPa) or in the 95 ksi grade (i.e. with a yield strength in the range of 95 to 110 ksi, i.e. a yield strength of 654 to 758 MPa) have been employed. Recently, however, steel pipes for oil wells in the 110 ksi strength grade (i.e. with a yield strength in the range of 110 to 125 ksi, i.e. a yield strength in the range of 758 to 861 MPa) are used in more and more cases.

Many deep oil wells that have been recently developed contain hydrogen sulfide, which is corrosive. In such an environment, an increased strength of steel means increased susceptibility of the steel to sulfide stress cracking (hereinafter referred to SSC). Many steel pipes for oil wells that are used in an environment containing hydrogen sulfide are low-alloy steel pipes, because martensitic stainless steel, which has good carbon dioxide gas corrosion resistance, has high susceptibility to SSC.

Although low-alloy steel has a relatively good SSC resistance, such a steel with increased strength has higher susceptibility to SSC. Thus, one needs to come up with various ideas for material designing for a steel pipe for an oil well that are used in an environment containing hydrogen sulfide to increase the strength of the steel pipe and, at the same time, ensure a certain SSC resistance.

To improve the SSC resistance of a steel, WO 2007/007678 discloses (1) improve the cleanliness of the steel; (2) quenching the steel and then tempering it at a high temperature; (3) making the crystal grains (prior austenite grains) of the steel finer; (4) making the particles of carbide produced in the steel finer or more spherical; and other approaches.

The low-alloy steel for an oil well described in this document has a chemical composition that satisfies 12V+1-Mo≥0, and, if it contains Cr, further satisfies Mo—(Cr+Mn) ≥0. According to this document, this low-alloy steel for an oil well has a high yield strength that is not lower than 861 MPa and exhibits good SSC resistance even in a corrosive environment with 1 atm $H_2S$.

JP 2000-178682 A discloses a steel for an oil well made of a low-alloy steel containing C: 0.2 to 0.35%, Cr: 0.2 to 0.7%, Mo: 0.1 to 0.5%, and V: 0.1 to 0.3%, where the total amount of precipitated carbide is in the range of 2 to 5 wt. %, of which MC-based carbide accounts for 8 to 40 wt. %. According to this document, this steel for an oil well has good SSC resistance and a yield strength of 110 ksi or higher. More specifically, this document describes that, in constant load tests complying with the TM0177 method A from the National Association of Corrosion Engineers (NACE) (in an aqueous solution of 5% NaCl and 0.5% acetic acid saturated with $H_2S$ at 25° C.), this steel for an oil well does not break under a load stress of 85% of its yield strength.

JP 2006-265657 A discloses a method of manufacturing a seamless steel pipe for an oil well, where a seamless steel pipe with a chemical composition having C: 0.30 to 0.60%, Cr+Mo: 1.5 to 3.0% (Mo being not less than 0.5%), V: 0.05 to 0.3% and other components is produced and, immediately after completion of rolling, water-cooled to a temperature range of 400 to 600° C. and, without an interruption, a bainitic isothermal transformation heat treatment is performed in a temperature range of 400 to 600° C. This document describes that this seamless steel pipe for an oil well has a yield strength of 110 ksi or higher, and, in constant load tests complying with the TM0177 method A from NACE, does not break under a load stress of 90% of its yield strength.

WO 2010/150915 discloses a method of manufacturing a seamless steel pipe for an oil well, wherein a seamless steel pipe containing C: 0.15 to 0.50%, Cr: 0.1 to 1.7%, Mo: 0.40 to 1.1% and other components is quenched under a condition that produces prior austenite grains with a grain size number of 8.5 or higher, and tempered in a temperature range of 665 to 740° C. According to this document, this method produces a seamless steel pipe for an oil well in the 110 ksi grade with good SSC resistance. More specifically, this document describes that, in constant load tests complying with the TM0177 method A from NACE, this seamless steel pipe for an oil well does not break under a load stress of at least 85% of its yield strength.

WO 2008/123425 describes a low-alloy steel for oil well pipes with good HIC resistance and SSC resistance in a high-pressure hydrogen sulfide environment and having a yield strength of 758 MPa or more, which contains C: 0.10 to 0.60%, Cr: 3.0% or less, Mo: 3.0% or less and other components, and satisfies the relationship represented by Cr+3Mo≥2.7%, where not more than 10 non-metallic inclusions with a length of their major axis of 10 μm are present in an area of 1 $mm^2$ of an observed cross-section.

Japanese Patent No. 5387799 describes a method of manufacturing a high-strength steel with good sulfide stress cracking resistance, including, after a steel having a predetermined chemical composition is hot-worked, [1] the step of heating the steel to a temperature above $Ac_1$ point and below $Ac_8$ point and then cooling it, [2] the step of reheating the steel to a temperature that is not lower than $Ac_3$ point and rapidly cooling it for quenching, and [3] the step of tempering the steel at a temperature that is not higher than $Ac_1$ point, the steps being performed in this order.

JP 2010-532821 A describes a steel composition containing C: 0.2 to 0.3%, Cr: 0.4 to 1.5%, Mo: 0.1 to 1%, W: 0.1 to 1.5% and other components, where Mo/10+Cr/12+W/25+Nb/3+25×B is in the range of 0.05 to 0.39% and the yield strength is in the range of 120 to 140 ksi.

Japanese Patent No. 5522322 describes a steel for a pipe for an oil well containing C: higher than 0.35% to 1.00%, Cr: 0 to 2.0%, Mo: higher than 1.0% to 10% and other components, where the yield strength is 758 MPa.

DISCLOSURE OF THE INVENTION

As exemplified by these documents, a number of steel pipe designs for an oil well having a yield strength of 110 ksi (i.e. 758 MPa) or higher and having good SSC resistance have been proposed. However, in some cases, even employing one of the techniques disclosed in the above patent documents may not achieve stable and economical industrial production of high-strength steel pipes for oil wells with good SSC resistance.

The reasons for this may be the following. In some of the above patent documents, the properties of steel are evaluated based on experiments using plates or steel pipes with a relatively small wall thickness. If these techniques are employed for a steel pipe, particularly a steel pipe with a large wall thickness, the difference in heating rate and cooling rate may not reproduce the intended properties. In addition, in large-scale industrial production, the segregates or precipitates produced during casting may be different from those in small-scale production.

For example, in WO 2008/123425, many of the experiments are conducted using plates, and, for those using steel pipes, their size is not described. As such, it is unclear whether desired properties can be provided in a stable manner when the technique of WO 2008/123425 is applied to a steel pipe with a large wall thickness.

Making prior austenite grains finer by quenching repeatedly may improve SSC resistance. However, repeated quenching increases manufacturing costs.

According to Japanese Patent No. 5387799, instead of repeating quenching, intermediate tempering is performed in a two-phase range after hot working, and then quenching and tempering are performed. Thus, Japanese Patent No. 5387799 provides a fine microstructure with a prior austenite grain size number of 9.5 or higher.

From the viewpoints of flexibility in manufacturing steps and stability of quality in industrial-scale production, it is preferable to ensure a certain SSC resistance even when the prior austenite grains are relatively coarse. Japanese Patent No. 5387799 provides good SSC resistance for steels with prior austenite grain size numbers that are not lower than 9.5; however, steels with size numbers below 9.5 do not have good SSC resistance.

An object of the present invention is to provide a high-strength low-alloy steel pipe for an oil well with a good and stable SSC resistance.

A low-alloy steel pipe for an oil well according to the present invention includes a chemical composition having, in mass %, C: not less than 0.15% and less than 0.30%, Si: 0.05 to 1.00%, Mn: 0.05 to 1.00%, P: not more than 0.030%, S: not more than 0.0050%, Al: 0.005 to 0.100%, O: not more than 0.005%, N: not more than 0.007%, Cr: not less than 0.10% and less than 1.00%, Mo: more than 1.0% and not more than 2.5%, V: 0.01 to 0.30%, Ti: 0.002 to 0.009%, Nb: 0 to 0.050%, B: 0 to 0.0050%, Ca: 0 to 0.0050%, and the balance being Fe and impurities, wherein the chemical composition satisfies the equation (1), the steel pipe has a crystal grain size number of prior austenite grains in accordance with ASTM E112 of not lower than 7.0, the steel pipe includes 50 or more particles of cementite with an equivalent circle diameter of not less than 200 nm being present in an area of 100 $\mu m^2$ of matrix, the steel pipe includes $M_2C$-based alloy carbide in a number density of not less than $25/\mu m^2$, and the steel pipe has a yield strength of not less than 758 MPa, $$Mo/Cr \geq 2.0 \quad (1),$$

wherein each of the chemical symbols in equation (1) is substituted for by the content of the corresponding element in mass %.

The present invention provides a high-strength low-alloy steel pipe for an oil well having a good and stable SSC resistance.

DESCRIPTION OF THE EMBODIMENTS

Figure 1:
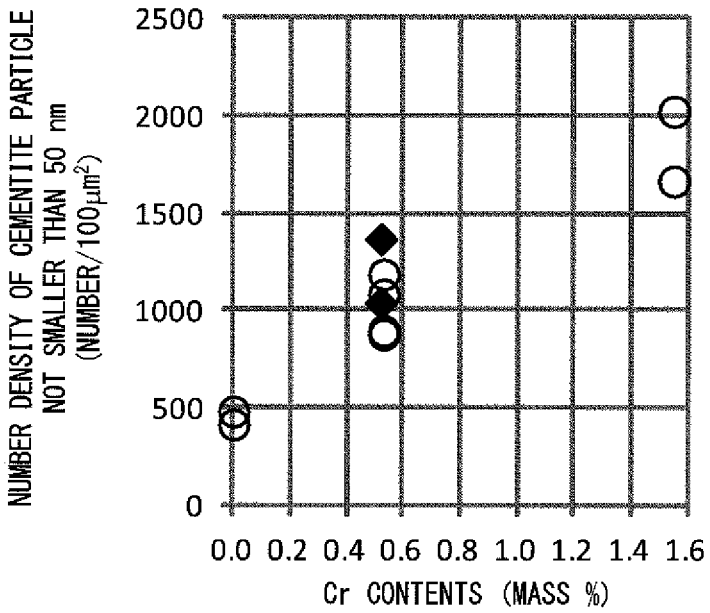
FIG. 1 is a graph showing the relationship between Cr content and the number density of cementite, where the number of particles of cementite having an equivalent circle diameter of not less than 50 nm is counted.

The present inventors made detailed research on the SSC resistance of low-alloy steel pipes for oil wells.

If the strength of a low-alloy steel pipe for an oil well is increased, the hardness increases as well. Typically, an increase in hardness decreases SSC resistance. Thus, conventionally, if the yield strength is to be 110 ksi (i.e. 758 MPa) or higher, efforts are made to increase yield ratio and reduce tensile strength. A reduction in tensile strength has substantially the same meaning as a reduction in hardness.

In such a conventional low-alloy steel pipe for an oil well, the SSC resistance varies as the hardness varies. As such, even if the yield strength is managed in a certain standard range, variations in the hardness may result in some material that does not meet the SSC resistance standard. It is assumed that, in the case of low-alloy steel pipes for oil wells in the 110 ksi grade, the SSC resistance typically decreases unless the hardness is managed below HRC 28.5. Recently, on the other hand, there are needs for sour-resistant grade low-alloy steel pipes for oil wells with still higher strengths, and products in the 115 ksi grade (i.e. with a yield strength of 793 MPa or more) are being developed. In the case of such low-alloy steel pipes for oil wells with high strength, it is very difficult to manage the hardness below HRC 28.5.

Instead of decreasing the hardness to improve the SSC resistance, as has been conventionally done, the present inventors attempted to provide a low-alloy steel pipes for oil wells having high hardness and still having good SSC resistance. As a result, the present inventors obtained the following findings.

(1) Typically, a low-alloy steel pipe for an oil well is made by hot forming and then quenching and tempering to produce a metal microstructure mainly composed of tempered martensite. The more spherical the particles of carbide precipitated during the tempering step, the better the SSC resistance of the steel becomes. The carbide precipitated during the tempering step is mainly cementite. During the tempering step, in addition to cementite, alloy carbides (for example, Mo carbide, V carbide, Nb carbide, and Ti carbide) also precipitate. If carbide precipitates along grain boundaries, the flatter in shape the carbide particles, the more easily SSC can occur where the carbide particles form starting points. In other words, the closer to the spherical shape the shape of the carbide particles, the less likely SSC can occur at carbide particles, improving the SSC resistance. Thus, to improve SSC resistance, it is preferable to make the particles of carbide, particularly cementite, more spherical.

(2) To improve SSC resistance, it is preferable to make the cementite particles more spherical and cause them to grow until their equivalent circle diameter is 200 nm or more. As cementite particles grow, the specific surface area of cementite precipitated in the steel decreases. Reducing the specific surface area of cementite improves SSC resistance.

Figure 2:
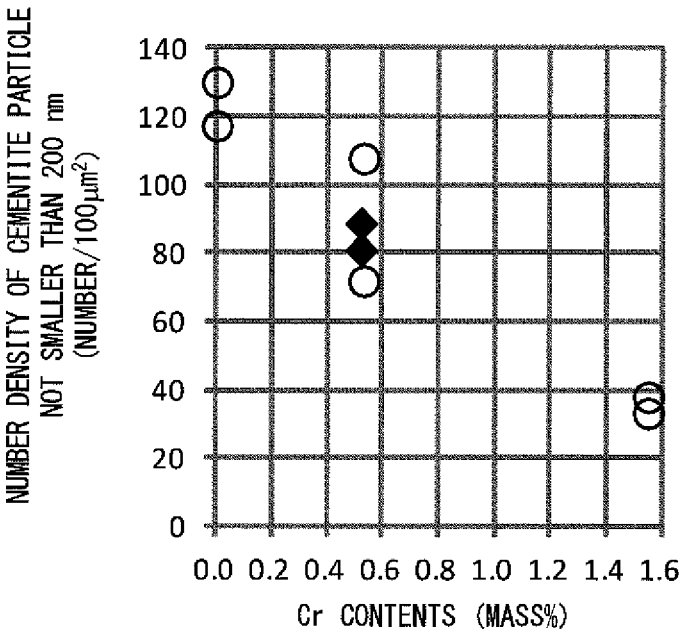
FIG. 2 is a graph showing the relationship between Cr content and the number density of cementite, where the number of particles of cementite having an equivalent circle diameter of not less than 200 nm is counted.

(3) Under the same tempering conditions, the growth rate for cementite is significantly affected by the Cr content in the steel. FIGS. 1 and 2 are graphs showing the relationship between Cr content and the number density of cementite. The horizontal axis of each of FIGS. 1 and 2 indicates the Cr content in the steel, while the vertical axis indicates the number of cementite particles in an area of 100 $\mu m^2$ of matrix. FIG. 1 is a graph where the number of cementite particles having an equivalent circle diameter of 50 nm or more (hereinafter referred to as "middle-to-large-particle cementite" for convenience) is counted, while FIG. 2 is a graph where the number of cementite particles having an equivalent circle diameter of 200 nm or more (hereinafter referred to as "large-particle cementite" for convenience) is counted. In FIGS. 1 and 2, "○" indicates a steel with an Mo content of 0.7%, while "◆" indicates a steel with an Mo content of 1.2%.

As shown in FIGS. 1 and 2, if the Cr content in the steel is small, the number of middle-to-large particles of cementite observed is small but the number of large particles of cementite is large. On the other hand, if the Cr content in the steel is large, the number of middle-to-large particles of cementite observed is large but the number of large particles of cementite is small.

(4) The opposite is true with $M_2C$-based alloy carbides such as $Mo_2C$ ("M" means metal): the more the number density, the more stable the SSC resistance of the steel becomes. Since cementite has only a small capability of trapping hydrogen, the larger the surface area of cementite particles, the smaller the SSC resistance of the steel becomes. On the other hand, $M_2C$-based alloy carbides have a large capability of trapping hydrogen, which improves the SSC resistance of the steel. Consequently, increasing the number density of $M_2C$-based alloy carbide to increase the surface area improves the SSC resistance of the steel.

Figure 3:
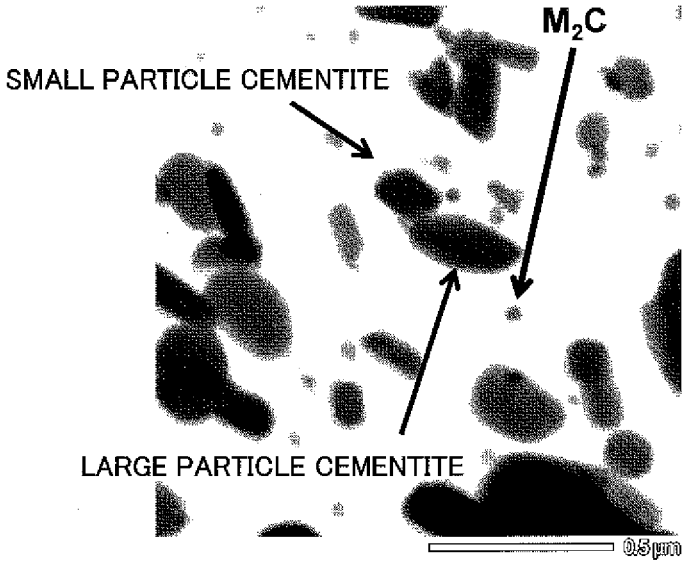
FIG. 3 shows a TEM image of metal microstructure of a steel with an Mo content of 0.7%.
Figure 4:
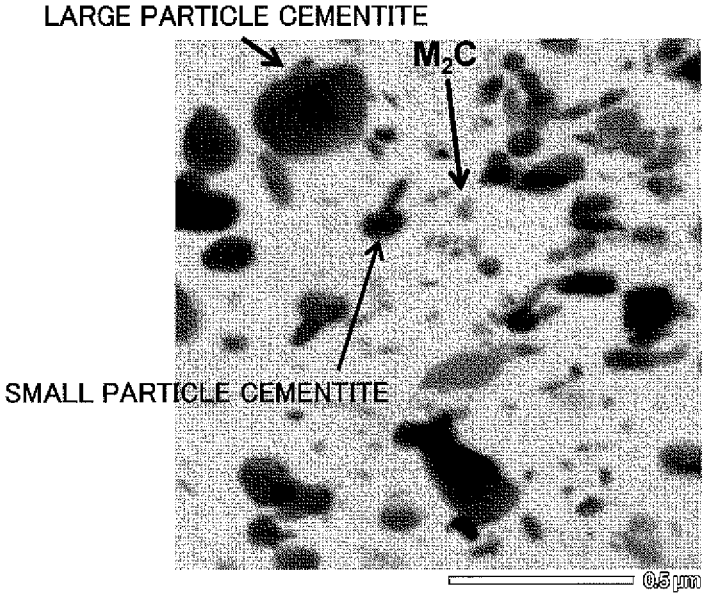
FIG. 4 shows a TEM image of metal microstructure of a steel with an Mo content of 1.2%.
Figure 5:
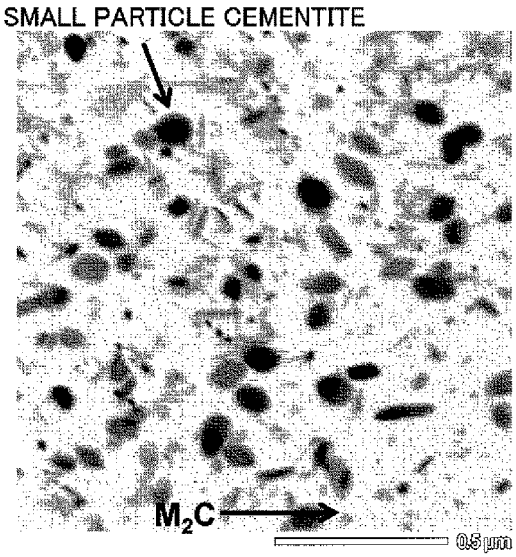
FIG. 5 shows a TEM image of metal microstructure of a steel with an Mo content of 2.0%.

FIGS. 3 to 5 shows transmission electron microscopic (TEM) images of carbides precipitated in steel. FIGS. 3 to 5 show TEM images of metal microstructures of steels with Mo contents of 0.7%, 1.2% and 2.0%, respectively. As shown in FIG. 3 to 5, the more the Mo content, the higher the number density of $M_2C$ (mainly $Mo_2C$). Further, the number density of $Mo_2C$ also depends on the Cr content such that an increase in the Cr content prevents the formation of $Mo_2C$. Consequently, to ensure a certain number density of $M_2C$-based alloy carbide, the steel must contain a certain amount of Mo and the ratio of Mo to Cr must be equal to or greater than a certain value.

The present inventors further attempted to obtain a low-alloy pipe for an oil well having good SSC resistance even with relatively coarse grains, instead of improving SSC resistance by making prior austenite grains finer, as is conventionally done. During this investigation, they found out that the Ti content must be strictly limited if the prior austenite grain size number is relatively small (i.e. the crystal grains are relatively large).

(5) Ti is effective in preventing casting-cracking. Further, Ti forms a nitride. A nitride contributes to prevention of crystal grains becoming coarse due to the pinning effect. However, coarse nitride particles make the SSC resistance of the steel unstable. If the crystal grains are relatively large, the effects of a nitride on the SSC resistance are relatively large. In order to obtain good and stable SSC resistance even with relatively large crystal grains, the Ti content must be limited to 0.002 to 0.009%.

The low-alloy steel pipe for an oil well according to the present invention was completed based on the above-described findings. Now, the low-alloy steel pipe for an oil well according to an embodiment of the present invention will be described in detail. In the following description, "%" indicating the content of an element means mass %.

[Chemical Composition]

The low-alloy steel pipe for an oil well according to the present embodiment includes the chemical composition described below.

C: not less than 0.15% and less than 0.30%

Carbon (C) increases the hardenability of steel and increases the strength of the steel. In addition, an increased C content is advantageous in forming large-particle cementite and also makes it easier to make cementite particles more spherical. In view of this, the steel of the present embodiment contains C in at least 0.15%. On the other hand, if the C content is 0.30% or larger, the susceptibility of the steel to quench-cracking increases. Particularly, a special cooling means (i.e. quenching method) is necessary for quenching a steel pipe. In addition, the toughness of the steel may decrease. In view of this, the C content should be not less than 0.15% and less than 0.30%. Preferably, the lower limit of C content is 0.18%; more preferably, it is 0.22%; still more preferably, it is 0.24%. Preferably, the upper limit of C content is 0.29%; more preferably, it is 0.28%.

Si: 0.05 to 1.00%

Silicon (Si) deoxidizes steel. This effect is insufficient if the Si content is less than 0.05%. On the other hand, if the Si content exceeds 1.00%, the SSC resistance decreases. In view of this, the Si content should be in the range of 0.05 to 1.00%. Preferably, the lower limit of Si content is 0.10%; more preferably, it is 0.20%. Preferably, the upper limit of Si content is 0.75%; more preferably, it is 0.50%; still more preferably, it is 0.35%.

Mn: 0.05 to 1.00%

Manganese (Mn) deoxidizes steel. This effect is negligible if the Mn content is less than 0.05%. On the other hand, if the Mn content exceeds 1.00%, it segregates along grain boundaries together with impurity elements such as P and S, decreasing the SSC resistance of the steel. In view of this, the Mn content should be in the range of 0.05 to 1.00%. Preferably, the lower limit of Mn content is 0.20%; more preferably, it is 0.28%. Preferably, the upper limit of Mn content is 0.85%; more preferably, it is 0.60%.

P: not more than 0.030%

Phosphorus (P) is an impurity. P segregates along grain boundaries and decreases the SSC resistance of steel. Thus, smaller P contents are preferable. In view of this, the P content should be not more than 0.030%. Preferably, the P content is not more than 0.020%; more preferably, it is not more than 0.015%; still more preferably, it is not more than 0.012%.

S: not more than 0.0050%

Sulphur (S) is an impurity. S segregates along grain boundaries and decreases the SSC resistance of steel. Thus, smaller S contents are preferable. In view of this, the S content should be not more than 0.0050%. Preferably, the S content is not more than 0.0020%; more preferably, it is not more than 0.0015%.

Al: 0.005 to 0.100%

Aluminum (Al) deoxidizes steel. If the Al content is less than 0.005%, the steel is insufficiently deoxidized, decreasing the SSC resistance of the steel. On the other hand, if the Al content exceeds 0.100%, oxide is produced, decreasing the SSC resistance of the steel. In view of this, the Al content should be in the range of 0.005 to 0.100%. Preferably, the lower limit of the Al content is 0.010%; more preferably, it is 0.020%. Preferably, the upper limit of Al content is 0.070%; more preferably, it is 0.050%. As used herein, the content of "Al" means the content of "acid-soluble Al", i.e. the content of "sol. Al".

O: not more than 0.005%

Oxygen (O) is an impurity. O forms coarse oxide particles, decreasing the pitting resistance of steel. Thus, preferably, the O content should be minimized. The oxide content should be not more than 0.005% (i.e. 50 ppm). Preferably, the O content is less than 0.005% (i.e. 50 ppm); more preferably, it is not more than 0.003% (i.e. 30 ppm); still more preferably, it is not more than 0.0015% (i.e. 15 ppm).

N: not more than 0.007%

Nitrogen (N) is an impurity. N forms nitride. If the nitride particles are fine, this contributes to prevention of crystal grains becoming coarse; however, if the nitrogen particles are coarse, this makes the SSC resistance of the steel unstable. Thus, smaller N contents are preferable. In view of this, the N content should be not more than 0.007% (i.e. 70 ppm). Preferably, the N content is not more than 0.005% (i.e. 50 ppm); more preferably, it is not more than 0.004% (i.e. 40 ppm). If the pinning effect due to the precipitation of fine nitride particles is desired, the steel preferably contains N in not less than 0.002% (i.e. 20 ppm).

Cr: not less than 0.10% and less than 1.00%

Chromium (Cr) increases the hardenability of steel and increases the strength of the steel. If the Cr content is less than 0.10%, it is difficult to ensure a sufficient level of hardenability. A Cr content below 0.10% results in a decrease in hardenability that allows bainite to be produced, potentially decreasing the SSC resistance. On the other hand, if the Cr content is not less than 1.00%, it is difficult to ensure a desired number density for large-particle cementite. In addition, the toughness of the steel can easily decrease. In view of this, the Cr content should be not less than 0.10% and less than 1.00%. Preferably, the lower limit of Cr content is 0.20%. Particularly, for a steel pipe with a large wall thickness, the lower limit of Cr content is preferably 0.23%; more preferably, it is 0.25%; still more preferably, it is 0.3%. Preferably, the upper limit of Cr content is 0.85%; more preferably, it is 0.75%.

Mo: more than 1.0% and not more than 2.5%

Molybdenum (Mo) increases the temper softening resistance of steel and contributes to improvement in the SSC resistance due to high-temperature tempering. In addition, Mo forms $Mo_2C$ and contributes to improvement in SSC resistance. In order that all of these effects are present, the Mo content above 1.0% is necessary. On the other hand, if the Mo content exceeds 2.5%, the steel is saturated with respect to the above effects and the costs increase. In view of this, the Mo content should be more than 1.0% and not more than 2.5%. Preferably, the lower limit of Mo content is 1.1%; more preferably, it is 1.2%. Preferably, the upper limit of Mo content is 2.0%; more preferably, it is 1.6%.

$$Mo/Cr \geq 2.0 \quad (1).$$

In the present embodiment, the Cr content and Mo content are in the above-described ranges and satisfy the above equation (1). That is, the ratio of the Mo content to the Cr content in mass %, Mo/Cr, is not less than 2.0. As discussed above, Mo forms $Mo_2C$ and contributes to improvement in SSC resistance. An increase in the Cr content prevents large-particle cementite from forming and also prevents $Mo_2C$ from forming. If Mo/Cr is less than 2.0, Cr makes the formation of $Mo_2C$ insufficient. Preferably, Mo/Cr is not less than 2.3.

V: 0.01 to 0.30%

Vanadium (V) increases the temper softening resistance of steel, and contributes to improvement in SSC resistance due to high-temperature tempering. Further, V helps form $M_2C$-based carbide. These effects are not present if the V content is less than 0.01%. On the other hand, if the V content exceeds 0.30%, the toughness of the steel decreases. In view of this, the V content should be in the range of 0.01 to 0.30%. Preferably, the lower limit of V content is 0.06%; more preferably, it is 0.08%. Preferably, the upper limit of V content is 0.20%; more preferably, it is 0.16%.

Ti: 0.002 to 0.009%

Titanium (Ti) is effective in preventing casting-cracking. In addition, Ti forms a nitride and contributes to prevention of crystal grains becoming coarse. In view of this, in the present embodiment, the steel contains Ti in at least 0.002%. On the other hand, if the Ti content exceeds 0.009%, large nitride particles are produced, making the SSC resistance of the steel unstable. In view of this, the Ti content should be in the range of 0.002 to 0.009%. Preferably, the lower limit of Ti content is 0.004%. Preferably, the upper limit of Ti content is 0.008%.

The balance of the chemical composition of the low-alloy steel pipe for an oil well according to the present embodiment is made of Fe and impurities. Impurity in this context means an element originating from ore or scraps used as material of steel or an element that enters from the environment or the like during the manufacturing process.

The low-alloy steel pipe for an oil well according to the present embodiment may contain, instead of part of Fe, one or more selected from the group consisting of Nb, B and Ca.

Nb: 0 to 0.050%

Niobium (Nb) is an optional additive element. Nb forms a carbide, nitride or carbonitride. Carbide, nitride and carbonitride make crystal grains of steel finer due to the pinning effect, increasing the SSC resistance of the steel Even a small amount of Nb provides the above effects. On the other hand, if the Nb content exceeds 0.050%, an excessive amount of nitride is produced, making the SSC resistance of the steel unstable. In view of this, the Nb content should be in the range of 0 to 0.050%. Preferably, the lower limit of Nb content is 0.005%; more preferably, it is 0.010%. Preferably, the upper limit of Nb content is 0.035%; more preferably, it is 0.030%.

B: 0 to 0.0050%

Boron (B) is an optional additive element. B increases the hardenability of steel. Even a small amount of B provides the above effects. On the other hand, B tends to form $M_{23}CB_6$ along grain boundaries such that if the B content exceeds 0.0050%, the SSC resistance of the steel decreases. In view of this, the B content should be in the range of 0 to 0.0050% (i.e. 50 ppm). Preferably, the lower limit of B content is 0.0001% (i.e. 1 ppm); more preferably, it is 0.0005% (i.e. 5 ppm). Regarding upper limit, preferably, the B content is less than 0.0050% (i.e. 50 ppm); more preferably, it is not more than 0.0025% (i.e. 25 ppm). To use the effects of B, it is preferable to minimize the N content or fix N with Ti such that B atoms that are not coupled with N atoms are present.

Ca: 0 to 0.0050%

Calcium (Ca) is an optional additive element. Ca prevents coarse Al-based inclusions from being produced, and forms fine Al—Ca-based oxysulphide particles. Thus, when steel material (a slab or round billet) is to be produced by continuous casting, Ca prevents the nozzle of the continuous casting apparatus from being clogged by coarse Al-based inclusions. Even a small amount of Ca provides the above effects. On the other hand, if the Ca content exceeds 0.0050%, the pitting resistance of the steel decreases. In view of this, the Ca content should be in the range of 0 to 0.0050% (i.e. 50 ppm). Preferably, the lower limit of Ca content is 0.0003% (i.e. 3 ppm); more preferably, it is 0.0005% (i.e. 5 ppm). Preferably, the upper limit of Ca content is 0.0045% (i.e. 45 ppm); more preferably, it is 0.0030% (i.e. 30 ppm).

[Metal Microstructure and Precipitates]

The low-alloy steel pipe for an oil well of the present embodiment includes the metal microstructure described below.

The low-alloy steel pipe for an oil well of the present embodiment includes a metal microstructure mainly composed of tempered martensite. Metal microstructure mainly composed of tempered martensite means a metal microstructure with a tempered martensite phase in a volume ratio of 90% or more. The SSC resistance of the steel decreases if the volume ratio of the tempered martensite phase is less than 90%, for example a large amount of tempered bainite is present.

The metal microstructure of the low-alloy steel pipe for an oil well of the present embodiment has prior austenite grains with a crystal grain size number in accordance with ASTM E112 of 7.0 or higher. Coarse grains with a crystal grain size number lower than 7.0 make it difficult to ensure a certain SSC resistance. Larger crystal grain size numbers are advantageous to ensure a certain SSC resistance. On the other hand, to achieve fine grains with a crystal grain size number of 10.0 or higher, high-cost manufacturing means must be used, for example, reheating/quenching must be performed more than once, or normalizing must be performed before reheating/quenching. Metal microstructure with a crystal grain size number of less than 10.0 can be achieved by reheating/quenching once, ensuring an intended SSC resistance. In view of this, from the viewpoint of manufacturing cost, the crystal grain size number of prior austenite grains is preferably lower than 10.0; more preferably, it is lower than 9.5; still more preferably, it is lower than 9.0. The prior austenite grain size can be measured by microscopic observation for an etched specimen. Furthermore, the prior austenite grain size number of ASTM can be also determined by crystal orientation mapping using Electron Back-Scatter Diffraction (EBSD).

In the low-alloy steel pipe for an oil well of the present invention, 50 or more particles of cementite with an equivalent circle diameter of 200 nm or larger (i.e. large-particle cementite) are present in an area of 100 $\mu m^2$ of matrix. In the case of the chemical composition specified by the present invention, cementite precipitates during tempering. SSC tends to occur where a boundary between cementite and matrix forms a starting point. Geometrically measured, given the same volume, a spherical precipitate has a smaller surface area than a flat one. Further, given the same total volume, the specific surface area is smaller if large precipitates are present than if a large number of fine precipitates are present. In the present invention, the cementite particles are made to grow to a relatively large size to reduce the boundaries between cementite and matrix, thereby ensuring a certain SSC resistance. If the number of large cementite particles in an area of 100 $\mu m^2$ of matrix is less than 50, it is difficult to ensure a certain SSC resistance. Preferably, 60 or more large cementite particles are present in an area of 100 $\mu m^2$ of matrix.

Further, in the low-alloy steel pipe for an oil well of the present invention, the number density of MzC-based alloy carbide is 25/$\mu m^2$ or more. Typically, M of the $M_2C$-based alloy carbide of the low-alloy steel pipe for an oil well of the present invention is Mo. Unlike cementite, the $M_2C$-based alloy carbide has a large capability of trapping hydrogen, improving the SSC resistance of the steel. In order that these effects are present, the number density of $M_2C$-based alloy carbide must be 25/$\mu m^2$ or more. Preferably, the number density of $M_2C$-based alloy carbide is 30/$\mu m^2$ or more.

Particles of $M_2C$-based alloy carbide with an equivalent circle diameter of 5 nm or larger are counted. In other words, in the low-alloy steel pipe for an oil well of the present invention, 25 or more particles of $M_2C$-based alloy carbide with an equivalent circle diameter of 5 nm or larger are present in an area of 1 $\mu m^2$ of matrix.

[Manufacturing Method]

Figure 6:
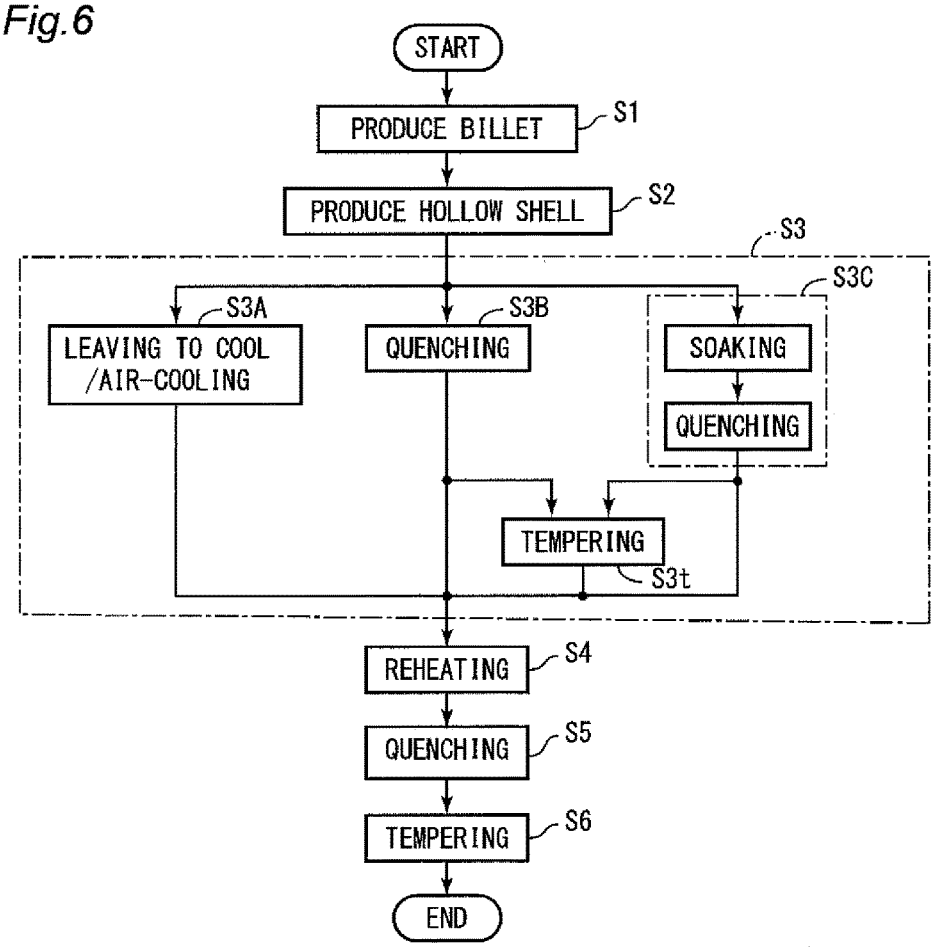
FIG. 6 is a flow chart of an exemplary method of manufacturing a low-alloy steel pipe.

An exemplary method of manufacturing a low-alloy steel pipe for an oil well according to the present invention will be described below. FIG. 6 is a flow chart showing an exemplary method of manufacturing a low-alloy steel pipe. This example illustrates an implementation where the low-alloy steel pipe for an oil well is a seamless steel pipe.

A billet having the above-described chemical composition is produced (step S1). First, steel having the above-described chemical composition is melted and refined using a well-known method. Subsequently, the melted steel is subjected to continuous casting to produce continuous-cast material. The continuous-cast material may be a slab, billet, or bloom, for example. Alternatively, the melted steel may be subjected to ingot-making to produce an ingot. The slab, bloom or ingot is hot-worked to produce a billet. The hot working may be hot rolling or hot forging, for example.

The billet is hot-worked to produce a hollow shell (step S2). First, the billet is heated in a heating furnace. The billet is extracted from the heating furnace and is hot-worked to produce a hollow shell. For example, a Mannesmann process may be performed as the hot working to produce a hollow shell. In such a case, a piercing machine is used to perform piercing-rolling on the round billet. The round billet that has undergone piercing-rolling is hot-rolled by a mandrel, reducer, sizing mill and other machines to produce a hollow shell. Other hot-working methods may be used to produce a hollow shell from the billet.

The steel pipe of the present invention may be suitably used as a steel pipe with a wall thickness of 10 to 50 mm, although it is not limited to this use. Further, it may be particularly suitably used as a steel pipe with a relatively large wall thickness, for example, a wall thickness that is not smaller than 13 mm, not smaller than 15 mm, or not smaller than 20 mm.

The significant features of the steel pipe of the present invention are the chemical composition specified by the present invention and the precipitation state of carbide. The precipitation state of carbide largely depends on the chemical composition and the final tempering conditions. Accordingly, as long as it is ensured that fine prior austenite grains with a crystal grain size number of 7.0 or higher are produced, the cooling process after hot working until tempering and the heat treatment are not limited to any particular methods. Typically, however, it is difficult to obtain fine prior austenite grains with a crystal grain size number of 7.0 or higher without a history of at least one reverse transformation from ferrite to austenite. In view of this, preferably, the steel pipe of the present invention is produced by producing a hollow shell, heating it off-line to a temperature that is higher than Acs point (step S4) and quenching (step S5).

If reheating and quenching are performed, the step after hot working results in a hollow shell having a desired outer diameter and wall thickness (the entire process after a hollow shell is produced by hot working until the reheating step is shown as step S3 in FIG. 6) is not limited to any particular method. The hollow shell after completion of hot forming may be left to cool or may be air-cooled (step S3A); after completion of hot forming, the hollow shell may be quenched directly starting from a temperature that is not lower than $Ar_3$ point (step S3B); or, after completion of hot forming, the hollow shell may be subjected to soaking (i.e. concurrent heating) at a temperature that is not lower than $Ar_3$ point by a soaking furnace located adjacent to the hot-forming equipment, and then quenched (i.e. so-called in-line heat treatment; step S3C).

If the hollow shell after hot rolling is to be left to cool or air-cooled (step S3A), it is preferably cooled to an environmental temperature or a temperature close to it.

If the process of step S3B or S3C above is performed, that means that quenching is performed a plurality of times if the reheating/quenching described below is also counted in, which is advantageous in making austenite crystal grains finer.

In the case of direct quenching (step S3B), the hollow shell after hot rolling is rapidly cooled (i.e. quenched) from a temperature near the rolling finishing temperature (which must be not lower than $Ar_3$ point) to a temperature that is not higher than the martensitic transformation starting temperature. The rapid cooling may be, for example, water cooling or mist spray cooling.

In the case of an in-line heat treatment (step S3C), first, the hollow shell after hot rolling is soaked at a temperature that is not lower than $Ar_3$ point, and the soaked hollow shell is rapidly cooled (i.e. quenched) from a temperature that is not lower than Ara point to a temperature that is not higher than the martensitic transformation starting temperature. The means of rapid cooling may be the same as those of direct quenching, discussed above.

In some cases, the steel pipe that has been quenched at step S3B or S3C may develop delayed fractures such as season cracks; to address this, after one of these steps, the pipe may be tempered at a temperature that is not higher than $Ac_1$ point (step S3*t*).

The hollow shell that has been processed by one of the above steps is reheated to a temperature that is not lower than Acs point and soaked (step S4). The reheated hollow shell is rapidly cooled (i.e. quenched) to a temperature that is not higher than the martensitic transformation starting temperature (step S5). The rapid cooling may be, for example, water cooling or mist spray cooling. The quenched hollow shell is tempered at a temperature that is not higher than $Ac_1$ point (step S6).

Preferably, the tempering temperature at step S6 is higher than 660° C.; more preferably, it is not lower than 680° C. If the tempering temperature is not higher than 660° C., the dislocation density of steel tends to be high, decreasing the SSC resistance of the steel. In addition, if it is not higher than 660° C., the Oswald ripening of cementite is insufficient, making it difficult to satisfy the number density of large-particle cementite described above.

A heat treatment such as normalizing may be performed between the heat treatment before reheating/quenching (step S3) and reheating (step S4). The reheating (step S4) and quenching (step S5) may be performed a plurality of times. Performing normalizing or performing quenching a plurality of times may even provide a fine grain microstructure with a crystal grain size number of 10.0 or higher.

From the viewpoint of manufacturing cost, it is preferable that, after the hollow shell is produced (step S2), it is left to cool or air-cooled (step S3A), and reheating (step S4) and quenching (step S5) are performed only once. The steel pipe of the present invention provides good SSC resistance even with relatively large crystal grains.

EXAMPLES

Now, the present invention will be described in more detail using examples. The present invention is not limited to these examples.

Steels A to O having the chemical compositions shown in Table 1 were melted, and continuous casting and blooming rolling were performed to produce billets for pipe production having an outer diameter of 310 mm. The balance of each of the chemical compositions of Table 1 is Fe and impurities. "Components conforming" in the column of "classification" of Table 1 indicates that the steel's chemical composition is in the range of the chemical composition of the present invention. "*" added to a value in Table 1 indicates that the value is outside the specified range of the present invention. The same applies to Tables 2 and 3.

TABLE 1

| | Mass % | | | | | | | | | | | Mass ppm | | | | | |
|---|---|---|---|---|---|---|---|---|---|---|---|---|---|---|---|---|---|
| Steel | C | Si | Mn | P | S | Cr | Mo | V | Ti | Nb | Al | B | Ca | O | N | Mo/Cr | Classification |
| A | 0.27 | 0.26 | 0.44 | 0.010 | 0.0011 | 0.32 | 1.26 | 0.11 | 0.006 | 0.030 | 0.035 | 11 | 12 | 12 | 49 | 3.9 | components conforming |
| B | 0.28 | 0.28 | 0.43 | 0.011 | 0.0008 | 0.52 | 1.25 | 0.13 | 0.006 | 0.030 | 0.035 | 11 | 10 | 10 | 40 | 2.4 | components conforming |
| C | 0.24 | 0.25 | 0.53 | 0.015 | 0.0015 | 0.63 | 2.00 | 0.07 | 0.002 | 0.020 | 0.030 | — | 15 | 17 | 31 | 3.2 | components conforming |
| D | 0.27 | 0.26 | 0.44 | 0.010 | 0.0011 | 0.55 | 1.15 | 0.21 | 0.006 | — | 0.035 | — | — | 14 | 49 | 2.1 | components conforming |
| E | 0.25 | 0.26 | 0.54 | 0.010 | 0.0011 | 0.70 | 1.70 | 0.10 | 0.008 | 0.005 | 0.035 | 11 | 12 | 13 | 25 | 2.4 | components conforming |
| F | 0.23 | 0.35 | 0.51 | 0.014 | 0.0004 | 0.25 | 1.10 | 0.13 | 0.004 | 0.015 | 0.033 | 17 | 4 | 18 | 43 | 4.4 | components conforming |
| G | 0.27 | 0.26 | 0.44 | 0.010 | 0.0011 | 0.90 | 1.85 | 0.10 | 0.007 | — | 0.035 | — | — | 12 | 49 | 2.1 | components conforming |
| H | 0.24 | 0.26 | 0.55 | 0.010 | 0.0021 | 0.85 | 1.15 | 0.08 | 0.006 | 0.029 | 0.030 | 12 | 10 | 13 | 40 | 1.4* | comparative steel |
| I | 0.28 | 0.26 | 0.43 | 0.010 | 0.0009 | 1.08* | 2.40 | 0.08 | 0.006 | 0.029 | 0.034 | 12 | 9 | 15 | 45 | 2.2 | comparative steel |
| J | 0.26 | 0.31 | 0.42 | 0.002 | 0.0011 | 0.05* | 1.96 | 0.10 | 0.003 | 0.012 | 0.031 | 24 | 20 | 18 | 35 | 39.2 | comparative steel |
| K | 0.28 | 0.27 | 0.45 | 0.010 | 0.0007 | 0.30 | 0.75* | 0.20 | 0.008 | 0.028 | 0.033 | 12 | 8 | 13 | 44 | 2.5 | comparative steel |
| L | 0.26 | 0.26 | 0.44 | 0.010 | 0.0010 | 0.95 | 2.20 | 0.10 | 0.025* | 0.031 | 0.036 | 12 | 15 | 18 | 39 | 2.3 | comparative steel |
| M | 0.28 | 0.26 | 0.50 | 0.010 | 0.0011 | 0.40 | 1.70 | 0.10 | 0.018* | 0.021 | 0.035 | 11 | 12 | 14 | 25 | 4.3 | comparative steel |
| N | 0.17 | 0.15 | 0.40 | 0.011 | 0.0007 | 0.27 | 1.13 | 0.05 | 0.003 | 0.017 | 0.033 | 11 | 10 | 13 | 37 | 4.2 | components conforming |
| O | 0.28 | 0.27 | 0.45 | 0.010 | 0.0007 | 0.98 | 1.05 | 0.10 | 0.006 | 0.003 | 0.033 | 10 | 8 | 13 | 44 | 1.1* | comparative steel |

Each billet was subjected to piercing-rolling and elongation-rolling by the Mannesmann mandrel method to produce a hollow shell (i.e. seamless steel pipe) having a size shown in the column of "Pipe size" of Table 2. Each value in the column of "OD" of Table 2 indicates the outer diameter of a hollow shell, while each value in the column of "WT" indicates the wall thickness of a hollow shell.

TABLE 2

| | | Pipe size | | Heat treatment | | |
|---|---|---|---|---|---|---|
| No. | Steel | OD (mm) | WT (mm) | Process before reheating/quenching | Quenching temperature (° C.) | Tempering temperature (° C.) |
| 1 | A | 244.5 | 13.8 | hot forming followed by leaving to cool | 920 | 700 |
| 2 | A | 244.5 | 13.8 | hot forming directly followed by water cooling | 920 | 700 |
| 3 | A | 244.5 | 13.8 | hot forming directly followed by water cooling + tempering | 920 | 690 |
| 4 | B | 346.1 | 15.9 | hot forming followed by leaving to cool | 920 | 705 |
| 5 | B | 346.1 | 15.9 | hot forming + soaking followed by water cooling | 920 | 700 |
| 6 | B | 346.1 | 15.9 | hot forming + soaking followed by water cooling + tempering | 920 | 700 |
| 7 | C | 346.1 | 20.5 | hot forming followed by leaving to cool | 950 | 700 |
| 8 | D | 244.5 | 13.8 | hot forming followed by leaving to cool | 920 | 695 |
| 9 | E | 244.5 | 20.5 | hot forming + soaking followed by water cooling + tempering | 920 | 695 |
| 10 | F | 244.5 | 20.5 | hot forming followed by leaving to cool | 920 | 700 |
| 11 | G | 244.5 | 13.8 | hot forming + soaking followed by water cooling + tempering | 920 | 695 |
| 12 | H* | 346.1 | 15.9 | hot forming followed by leaving to cool | 920 | 700 |
| 13 | I* | 244.5 | 13.8 | hot forming followed by leaving to cool | 920 | 700 |
| 14 | J* | 346.1 | 30.2 | hot forming followed by leaving to cool | 920 | 700 |
| 15 | K* | 244.5 | 13.8 | hot forming followed by leaving to cool | 920 | 700 |
| 16 | L* | 244.5 | 13.8 | hot forming followed by leaving to cool | 920 | 700 |
| 17 | M* | 244.5 | 13.8 | hot forming followed by leaving to cool | 920 | 700 |
| 18 | N | 244.5 | 13.8 | hot forming + soaking followed by water cooling + tempering | 920 | 600 |
| 19 | O | 244.5 | 13.8 | hot forming + soaking followed by water cooling + tempering | 920 | 695 |

Each hollow shell after rolling was subjected to a process indicated in the column of "Process before reheating/quenching" of Table 2. More specifically, if an entry of this column indicates "hot forming followed by leaving to cool", a process corresponding to step S3A of FIG. 6 was performed. For "hot forming directly followed by water cooling", a process corresponding to step S3B of FIG. 6 was performed. For "hot forming directly followed by water cooling+tempering", a process corresponding to steps S3B and S3*t* of FIG. 6 was performed. For "hot forming+soaking followed by water cooling", a process corresponding to step S3C of FIG. 6 was performed. For "hot forming+soaking followed by water cooling+tempering", a process corresponding to steps S3C and S3*t* of FIG. 6 was performed. The soaking step in "hot forming+soaking followed by water cooling" and "hot forming+soaking followed by water cooling+tempering" was performed at 920° C. for 15 minutes. The tempering step in "hot forming directly followed by water cooling+tempering" and "hot forming+soaking followed by water cooling+tempering" was performed at 500° C. for 30 minutes.

Each hollow shell that had been subjected to a process indicated in the column of "Process before reheating/quenching" was reheated to the corresponding temperature indicated in the column of "Quenching temperature" of Table 2 and soaked for 20 minutes, and then was quenched by water quenching. Each hollow shell that had been quenched was soaked (tempered) at the corresponding temperature indicated in the column of "Tempering temperature" of Table 2 for 30 minutes to produce the low-alloy steel pipe for an oil well of Nos. 1 to 19.

[Testing Method]

[Prior Austenite Grain Size Test]

From the low-alloy steel pipe for an oil well of each number that had been subjected to the process until the quenching, a specimen having a cross-section perpendicular to the longitudinal direction of the steel pipe (hereinafter referred to as observed surface) was obtained. The observed surface of each specimen was mechanically polished. After polishing, Picral etching reagent was used to cause prior austenite grain boundaries on the observed surface to appear. Thereafter, the crystal grain size number of the prior austenite grains on the observed surface was determined in accordance with ASTM E112.

[Hardness Test]

From the low-alloy steel pipe for an oil well of each number, a specimen having a cross-section perpendicular to the longitudinal direction of the steel pipe (hereinafter referred to as observed surface) was obtained. The observed surface of each specimen was mechanically polished. In accordance with JIS G0202, the Rockwell hardness in C scale of the portion of each polished specimen that corresponded to the center of the wall thickness of the steel pipe was determined. The hardness was measured after tempering as well as before tempering.

[Tensile Test]

From the low-alloy steel pipe for an oil well of each number, an arc-shaped specimen for tensile testing was obtained. The cross-section of the arc-shaped specimen for tensile testing was arc-shaped, and the longitudinal direction of the arc-shaped specimen for tensile testing was parallel to the longitudinal direction of the steel pipe. The arc-shaped specimen for tensile testing was used to conduct a tensile test at room temperature in accordance with 5CT of the American Petroleum Institute (API) standard. Based on the test results, the yield strength YS (MPa) and tensile strength TS (MPa) of each steel pipe were determined.

[Counting of Number of Particles of Cementite and $M_2C$-Based Alloy Carbide]

From a region including the center of the thickness of the low-alloy steel pipe for an oil well of each number, a specimen for TEM observation was obtained using the extraction replica method. More specifically, a specimen was polished and its observed cross-section was immersed in a 3% nitric acid-alcohol solution (nital) for 10 seconds, and then the observed cross-section surface was covered with a replica film. Then, the specimen was immersed in 5% nital through the replica film to cause the replica film to peel off the specimen. The floating replica film was transferred into clean liquid ethanol to clean it. Finally, the replica film was scooped up by a sheet mesh and dried to provide a replica film specimen for precipitate observation. Precipitates were observed and identified using TEM and energy dispersion-type X-ray spectroscopy (EDS). The numbers of different precipitates were counted by image analysis.

Figure 7:
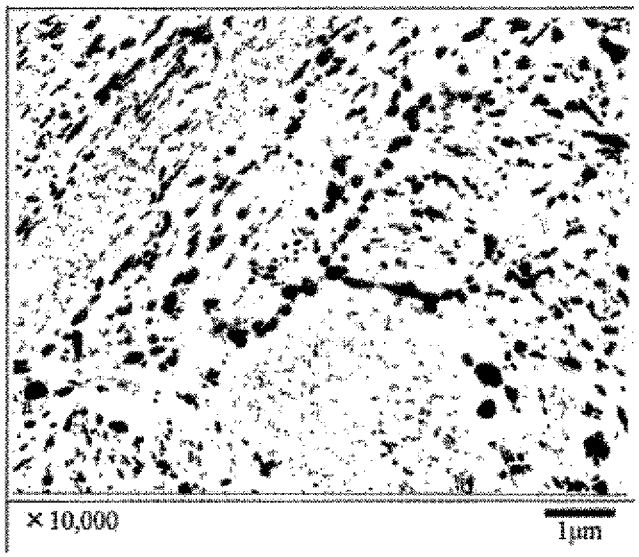
FIG. 7 shows a TEM image of carbide using replica films.

The image analysis will be described in detail with reference to FIGS. 7 and 8. The image analysis was conducted using image analysis software (mnageJ 1.47v). FIG. 7 shows a TEM image of carbide particles using replica films.

Figure 8:
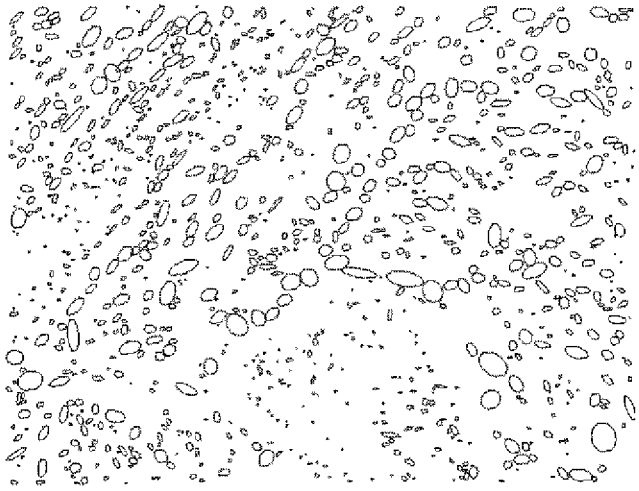
FIG. 8 shows an image produced by extracting contours of carbide particles of FIG. 7 using image analysis.

FIG. 8 shows an image produced by extracting contours of carbide particles of FIG. 7 using image analysis. In this example, the surface area of each carbide particle was determined by elliptic approximation and, based on the surface area, the equivalent circle diameter (i.e. diameter) of each carbide particle was determined. The number of carbide particles with an equivalent circle diameter that is not smaller than a predetermined value was counted, and this number was divided by the surface area of the field of vision to determine the number density.

[SSC Resistance Evaluation Test]

[Constant Load Test]

From the low-alloy steel pipe for an oil well of each number, a round bar specimen was obtained. The outer diameter of the parallel portion of each round bar specimen was 6.35 mm, and the length of the parallel portion was 25.4 mm. In accordance with the NACE TM0177 method A, constant load tests were conducted to evaluate the SSC resistance of each round bar specimen. The testing bath was an aqueous solution of 5% sodium chloride and 0.5% acetic acid at room temperature, saturated with $H_2S$ gas at 1 atm. To each round bar specimen was applied a load stress corresponding to 90% of the actual yield stress (AYS) of the low-alloy steel pipe for an oil well of the corresponding number, and each specimen was immersed in the testing bath for 720 hours. After 720 hours, it was determined whether each round bar specimen had broken or not, and, if it had not broken, it was determined that this steel had a high SSC resistance. If it had broken, it was determined that this steel had a low SSC resistance.

[Four-Point Bending Test]

From the low-alloy steel pipe for an oil well of each number, a specimen with a thickness of 2 mm, a width of 10 mm and a length of 75 mm was obtained. To each specimen was applied a distortion of a predetermined amount by four-point bending in accordance with ASTM G39. Thus, to each specimen was applied a stress corresponding to 90% of the actual yield stress (AYS) of the low-alloy steel pipe for an oil well of the corresponding number. The specimen to which a stress had been applied, together with the test jig, was enclosed in an autoclave. Thereafter, a desired 5% sodium chloride solution was injected into the autoclave, with a gaseous phase left. Subsequently, $H_2S$ gas at 5 atm or 10 atm was enclosed under pressure in the autoclave and the solution was stirred to saturate the solution with $H_2S$ gas. After the autoclave was sealed, the solution was kept at 24° C. for 720 hours while being stirred. Thereafter, the autoclave was decompressed and the specimen was removed. The removed specimen was observed visually for SSC, and, if it had not broken, it was determined that this steel had a high SSC resistance. If it had broken, it was determined that this steel had a low SSC resistance.

[Test Results]

The test results are shown in Table 3. Each entry of the column of "Grain size No." of Table 3 has a crystal grain size number of prior austenite grains of the low-alloy steel pipe for an oil well of the corresponding number. The column of "YS" has values of yield strength, the column of "TS" has values of tensile strength, and the column of "HRC" has values of Rockwell hardness of the specimen after the final tempering step. "No SSC" in the column of "SSC resistance evaluation" indicates that no SSC was found in the corresponding test. "SSC" in this column indicates that SSC was found in the corresponding test. "-" in this column indicates that no corresponding test was conducted. All examples Nos. 1 to 19 had the yield strength of 758 MPa or more and the hardness (HIRC) of 28.5 or more in the condition after the final tempering step. Regarding the hardness before the final tempering step, sparing the description on the individual hardness, it was determined that the low-alloy steel pipes for oil wells of Nos. 1 to 19, except No. 14, had a metal microstructure with a volume ratio of a martensitic phase of 90% or higher. This determination was made based on whether a given steel satisfied or exceeded the minimum hardness after quenching for ensuring a volume ratio of a martensitic phase of 90% or higher:

$$HRCmin=58\times(\%\ carbon)+27,$$

described in API Specification 5CT/ISO 11960.

TABLE 3

| | Grain | Mechanical characteristics | | | Microstructure | | SSC resistance evaluation | | | |
|---|---|---|---|---|---|---|---|---|---|---|
| | | | | | Number density of $M_2C$ | Number density of large-particle cementite | NACE TM0177 | 4-point | 4-point | |
| No. | size No. | YS (MPa) | TS (MPa) | HRC | (number of particles/$\mu m^2$) | (number of particles/100 $\mu m^2$) | method A 1 atm$H_2S$ | bending test 5 atm$H_2S$ | bending test 10 atm$H_2S$ | Classification |
| 1 | 8 | 848 | 903 | 28.8 | 48 | 90 | No SSC | No SSC | No SSC | Inventive Ex. |
| 2 | 9.2 | 862 | 924 | 29.9 | 45 | 100 | No SSC | No SSC | No SSC | Inventive Ex. |
| 3 | 8.7 | 862 | 924 | 29.7 | 65 | 87 | No SSC | No SSC | No SSC | Inventive Ex. |
| 4 | 8.7 | 841 | 903 | 28.9 | 25 | 85 | No SSC | No SSC | No SSC | Inventive Ex. |

TABLE 3-continued

| No. | Grain size No. | Mechanical characteristics YS (MPa) | TS (MPa) | HRC | Microstructure: Number density of $M_2C$ (number of particles/μm$^2$) | Number density of large-particle cementite (number of particles/100 μm$^2$) | SSC resistance evaluation: NACE TM0177 method A 1 atm$H_2S$ | 4-point bending test 5 atm$H_2S$ | 4-point bending test 10 atm$H_2S$ | Classification |
|---|---|---|---|---|---|---|---|---|---|---|
| 5 | 9.6 | 869 | 931 | 30.3 | 34 | 95 | No SSC | No SSC | No SSC | Inventive Ex. |
| 6 | 9.5 | 876 | 931 | 29.7 | 30 | 90 | No SSC | No SSC | No SSC | Inventive Ex. |
| 7 | 8.5 | 862 | 931 | 30.0 | 62 | 100 | No SSC | No SSC | No SSC | Inventive Ex. |
| 8 | 7.5 | 793 | 869 | 28.5 | 26 | 95 | No SSC | No SSC | No SSC | Inventive Ex. |
| 9 | 9.3 | 834 | 889 | 29.0 | 30 | 60 | No SSC | No SSC | No SSC | Inventive Ex. |
| 10 | 9 | 855 | 889 | 29.1 | 45 | 120 | No SSC | No SSC | No SSC | Inventive Ex. |
| 11 | 8 | 827 | 876 | 28.7 | 55 | 60 | No SSC | No SSC | No SSC | Inventive Ex. |
| 12 | 8.8 | 834 | 896 | 29.3 | 15* | 55 | SSC | — | — | Comparative Ex. |
| 13 | 8.3 | 834 | 903 | 29.0 | 30 | 35* | SSC | — | — | Comparative Ex. |
| 14 | 8 | 793 | 903 | 29.0 | 100 | 110 | SSC | — | — | Comparative Ex. |
| 15 | 8.1 | 862 | 917 | 29.5 | 25 | 80 | SSC | — | — | Comparative Ex. |
| 16 | 8.2 | 869 | 938 | 30.2 | 25 | 50 | SSC | — | — | Comparative Ex. |
| 17 | 9.3 | 862 | 931 | 30.0 | 55 | 80 | SSC | — | — | Comparative Ex. |
| 18 | 9.3 | 862 | 931 | 30.0 | 30 | 30* | SSC | — | — | Comparative Ex. |
| 19 | 9.1 | 836 | 914 | 29.1 | 23* | 60 | SSC | — | — | Comparative Ex. |

The low-alloy steel pipes for oil wells of Nos. 1 to 11 had element contents within the range of the present invention (steels A to G), and satisfied equation (1). Further, in each of the low-alloy steel pipes for oil wells of Nos. 1 to 11, the crystal grain size number of prior austenite grains was not lower than 7.0, the number density of $M_2C$-based alloy carbide was not less than 25/μm$^2$, and 50 or more particles of cementite with an equivalent circle diameter of 200 nm or larger (i.e. large-particle cementite) were present in an area of 100 μm$^2$ of matrix.

As shown in Table 3, each of the low-alloy steel pipes for oil wells of Nos. 1 to 11 had a yield strength that is not lower than 758 MPa and a Rockwell hardness that is not lower than 28.5. In the low-alloy steel pipes for oil wells of Nos. 1 to 11, no SSC was found in the SSC resistance evaluation tests.

In the low-alloy steel pipe for an oil well of Test No. 12, SSC was found in the SSC resistance evaluation test. This is presumably because its chemical composition did not satisfy equation (1) and the number density of $M_2C$-based alloy carbide was less than 25/μm$^2$.

In the low-alloy steel pipe for an oil well of Test No. 13, SSC was found in the SSC resistance evaluation test. This is presumably because the Cr content was too large and the number of particles of large-particle cementite was less than 50 in an area of 100 μm$^2$ of matrix.

In the low-alloy steel pipe for an oil well of Test No. 14, SSC was found in the SSC resistance evaluation test. This is presumably because its wall thickness was relatively large and the Cr content was too small, resulting in insufficient quenching and producing bainite microstructure.

In the low-alloy steel pipe for an oil well of Test No. 15, SSC was found in the SSC resistance evaluation test. This is presumably because the Mo content was too small.

In the low-alloy steel pipe for an oil well of Test No. 16, SSC was found in the SSC resistance evaluation test. This is presumably because the Ti content was too large.

In the low-alloy steel pipe for an oil well of Test No. 17, SSC was found in the SSC resistance evaluation test. This is presumably because the Ti content was too large.

In the low-alloy steel pipe for an oil well of Test No. 18, SSC was found in the SSC resistance evaluation test. This is presumably because the tempering temperature was low such that cementite particles did not become coarse, and the number of particles of large-particle cementite was less than 50 in an area of 100 μm$^2$ of matrix, which is insufficient.

In the low-alloy steel pipe for an oil well of Test No. 19, SSC was found in the SSC resistance evaluation test. This is presumably because the chemical composition did not satisfy equation (1) and the number density of $M_2C$-based alloy carbide was less than 25/μm$^2$.

What is claimed is:

1. A low-alloy steel pipe for an oil well, comprising a chemical composition consisting of, in mass %, C: not less than 0.15% and less than 0.30%, Si: 0.05 to 1.00%, Mn: 0.05 to 1.00%, P: not more than 0.030%, S: not more than 0.0050%, Al: 0.005 to 0.100%, O: not more than 0.005%, N: not more than 0.007%, Cr: not less than 0.10% and less than 1.00%, Mo: more than 1.0% and not more than 2.5%, V: 0.01 to 0.30%, Ti: 0.002 to 0.009%, Nb: 0 to 0.050%, B: 0 to 0.0050%, Ca: 0 to 0.0050%, and the balance being Fe and impurities, wherein the chemical composition satisfies the equation (1), the steel pipe has a crystal grain size number of prior austenite grains in accordance with ASTM E112 of not lower than 7.0, the steel pipe includes 50 or more particles of cementite with an equivalent circle diameter of not less than 200 nm being present in an area of 100 μm$^2$ of matrix, the steel pipe includes $M_2C$-based alloy carbide in a number density of not less than 25/μm$^2$, and the steel pipe has a yield strength of not less than 758 MPa, $$Mo/Cr \leq 2.0 \quad (1),$$

wherein each of the chemical symbols in equation (1) is substituted for by the content of the corresponding element in mass %.

2. The low-alloy steel pipe for the oil well according to claim 1, wherein the chemical composition contains one or more selected from the group consisting of, in mass %, Nb: 0.003 to 0.050%, B: 0.0001 to 0.0050%, and Ca: 0.0003 to 0.0050%.

3. The low-alloy steel pipe for the oil well according to claim 1, wherein the yield strength is not lower than 793 MPa.

4. The low-alloy steel pipe for the oil well according to claim 1, wherein the steel pipe has a Rockwell hardness of not lower than 28.5.

5. The low-alloy steel pipe for the oil well according to claim 2, wherein the yield strength is not lower than 793 MPa.

6. The low-alloy steel pipe for the oil well according to claim 2, wherein the steel pipe has a Rockwell hardness of not lower than 28.5.

7. The low-alloy steel pipe for the oil well according to claim 3, wherein the steel pipe has a Rockwell hardness of not lower than 28.5.

8. The low-alloy steel pipe for the oil well according to claim 5, wherein the steel pipe has a Rockwell hardness of not lower than 28.5.

* * * * *